US007712548B2

(12) United States Patent
Moessnang

(10) Patent No.: US 7,712,548 B2
(45) Date of Patent: May 11, 2010

(54) HAND-HELD POWER TOOL WITH AN OSCILLATION DAMPER

(75) Inventor: Franz Moessnang, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 105 days.

(21) Appl. No.: 12/011,894

(22) Filed: Jan. 29, 2008

(65) Prior Publication Data

US 2008/0185165 A1 Aug. 7, 2008

(30) Foreign Application Priority Data

Jan. 31, 2007 (DE) ..... 10 2007 000 059

(51) Int. Cl.
*B25D 17/24* (2006.01)
*B25D 17/06* (2006.01)

(52) U.S. Cl. ..... 173/162.1; 173/162.2; 173/48; 173/201; 173/210

(58) Field of Classification Search ..... 173/162.1, 173/162.2, 201, 210; 267/137; 92/85 R
See application file for complete search history.

(56) References Cited

U.S. PATENT DOCUMENTS

| | | | | |
|---|---|---|---|---|
| 2,152,427 | A * | 3/1939 | Wolf | 267/186 |
| 2,875,731 | A * | 3/1959 | Settles et al. | 267/137 |
| 3,845,827 | A * | 11/1974 | Schulin | 173/162.1 |
| 4,282,938 | A * | 8/1981 | Minamidate | 173/162.2 |
| 6,763,897 | B2 * | 7/2004 | Hanke et al. | 173/210 |

* cited by examiner

*Primary Examiner*—Rinaldi I. Rada
*Assistant Examiner*—Nathaniel Chukwurah
(74) *Attorney, Agent, or Firm*—Abelman, Frayne & Schwab

(57) ABSTRACT

A hand-held power tool includes a pneumatic percussing mechanism (3) located in the power tool housing (2) and having an anvil (5) and a percussion piston (4) for applying blows to the anvil (5), and at least one oscillation damper (6, 6') including an oscillation damping mass (7, 7'), at least one spring (8*a*, 8*a'*) for compressively preloading the damping mass (7, 7') against the power tool housing (2), and an axially displaceable excitation member (9) for actively exciting the oscillation damper (6, 6') in response to the anvil (5) occupying an operational position.

5 Claims, 1 Drawing Sheet

HAND-HELD POWER TOOL WITH AN OSCILLATION DAMPER

BACKGROUND OF THE INVENTION

1. Field of the Invention

The present invention relates to a hand-held power tool and, in particular, a hammer drill, a combination hammer and chisel hammer with an active oscillation damper.

2. Description of the Prior Art

An oscillation damper represents an oscillation-capable sub-system that consists of an abstract oscillating mass, an abstract spring, and an abstract damper and that is not necessarily needed to be explicitly formed of concrete components. In particular, the abstract damper often is not formed by concrete components but nevertheless functions by using friction and flow losses which practically always present. There exist two types of dampers, conventional passive oscillation dampers that exclusively are self-excited, and actively controlled dampers which are purposefully independently excited, using primarily a periodic excitation function.

By a suitable selection of spring constant and mass, in a passive damper, its natural frequency can be so dimensioned that it is closed to a to-be-damped interference frequency, in the present case, to the oscillations of the outer housing of the hand-held power tool.

With an active oscillation damper, which is excited primarily with a frequency above the natural frequency by the interference frequency, a good reduction of vibrations of the outer housing is achieved without a damaging beat effect.

French Publication FR 2,237,734 discloses use of a passive oscillation damper for preventing oscillation of a housing of a percussion hand-held power tool.

U.S. Pat. No. 4,478,293 discloses synchronization of operation of two passive oscillation dampers by using compressed air pulsation.

German Publication DE 815 179 discloses an arrangement of two passive oscillation dampers on opposite lateral sides of a percussion mechanism.

European Publication EP 1 710 052 discloses an arrangement of a hollow cylindrical passive oscillation damper around of a guide tube of a percussion mechanism.

International Publication WO 2006/022345 discloses an arrangement of a plurality of compact oscillation dampers within the outer housing of a power tool.

European Publication EP 1 464 449 discloses an arrangement of an actively controlled oscillation damper about a guide tube of a percussion mechanism and which is controlled by pressure fluctuations produced during driving of a drive piston of the power tool. At a faulty pressure of the power tool against an object, in addition to deactivation of the percussion mechanism, the oscillation damper, which is actively controlled by a displaceable control sleeve, is also deactivated.

An object of the present invention is to provide a hand-held power tool having a constructively simple oscillation damper that becomes deactivated at a faulty pressure of the power tool against an object.

SUMMARY OF THE INVENTION

This and other objects of the present invention, which will become apparent hereinafter, are achieved by providing a hand-held power tool including a housing, a pneumatic percussion mechanism located in the housing and having an anvil and a percussion piston for applying blows to the anvil, and at least one oscillation damper including an oscillating damping mass, at least one spring for compressively preloading the damping mass against the power tool housing, and an axially displaceable excitation member for actively exciting the oscillation damper in response to the anvil occupying an operational position.

With the excitation of an oscillation damper by an anvil, the oscillation damper will be only then activated with a frequency of blows when the anvil occupies, as a result of the power tool being pressed against an object, its operational, action-ready, position, and would not be activated as a result of a faulty press-on of the power tool in an idle blow position in which the oscillation damper passively oscillates.

Advantageously, the excitation member at least partially circumferentially engages a guide tube for the anvil. Thereby, the excitation member becomes displaced by a direct contact with the anvil, in particular during a rebound of a percussively driven working tool.

Advantageously, the excitation member is formed as a ring-shaped member. Therefore, when the excitation member is in contact with the anvil, no inclination or bending takes place.

Advantageously, the oscillation damper is formed as a hollow cylindrical element, which permits to circumferentially arrange it about the pneumatic percussion mechanism.

Alternatively, the oscillation damper can be formed as a compact element, which permits to arrange it sidewise of the pneumatic percussion mechanism as it occupies little space.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
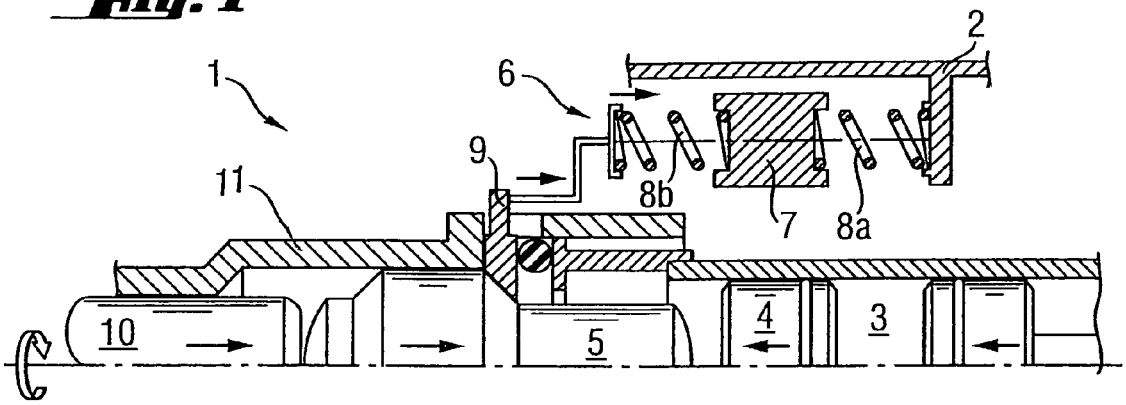
FIG. 1 a cross-sectional longitudinal partial view of a hand-held power tool according to the present invention with an oscillation damper.

A hand-held rotary-percussion power tool 1, which is shown in FIG. 1 includes a housing 2, a pneumatic percussion mechanism 3 located in the housing 2 and having an anvil 5 and a percussion piston 4 for applying blows to the anvil 5, and two compact oscillation dampers 6 of which only one oscillation damper is shown in the drawing. The dampers 6 are arranged mirror-symmetrically. The oscillation damper 6 has an oscillating damping mass 7 that is axially compressively preloaded against the housing 2 by a first spring 8*a*. In addition, a second spring 8*b* connects the damping mass 7 with an axially displaceable excitation member 9 that actively excites the oscillation damper 6 in response to the anvil 5 being pushed back by a rebounding working tool 10. The excitation member 9 partially circumferentially engages the guide tube 11 in which the anvil 5 is displaceable.

Figure 2:
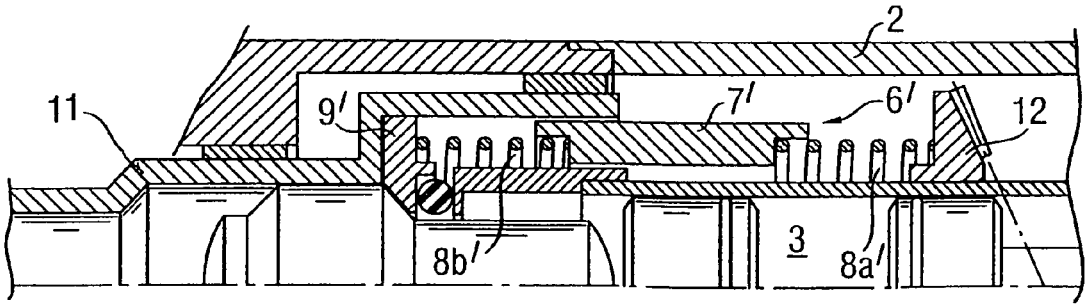
FIG. 2 a view similar to that of FIG. 1 of another embodiment of a hand-held power tool according to the present invention with an oscillation damper.

In the embodiment shown in FIG. 2, the oscillation damper 6' is formed as a hollow cylindrical element (with respect to the damping mass 7' and first and second springs 8*a*' and 8*b*')

that surrounds the pneumatic percussion mechanism 3. The excitation member 9' is formed as a ring-shaped member. Also, in the embodiment shown in FIG. 2, the first spring 8*a*' supports the oscillation damper 6' axially against a drive pinion 12 that is fixedly secured axially in the housing 2.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A hand-held power tool, comprising a housing (2); a pneumatic percussion mechanism (3) located in the housing (2) and including an anvil (5) and a percussion piston (4) for applying blows to the anvil (5); at least one oscillation damper (6, 6') for damping axial oscillations of the anvil (5) produced by a rebounding working tool (10), the at least one oscillation damper (6, 6') including an oscillation damping mass (7, 7') and at least one spring (8*a*, 8*a*') for compressively preloading the damping mass (7, 7') against the housing (2); and an axially displaceable excitation member (9) engageable by the anvil (5) in an operational position of the anvil (5) for transmitting the axial oscillations of the anvil (5) to the oscillation damper (6, 6') for actively exciting the oscillation damper (6, 6') when the anvil (5) occupies the operational position thereof.

2. A hand-held power tool according to claim 1, further comprising spring means (8*b*, 8*b*) for connecting the excitation member (9) with the oscillation damper (6, 6').

3. A hand-held power tool according to claim 1, wherein the at least one oscillation damper (6, 6') is arranged sideways of the pneumatic percussion mechanism (3), wherein the power tool comprises a guide tube (11) for the anvil (5), and wherein the excitation member (9) extends through the guide tube (11), extending partially into the guide tube (11) for engagement with the anvil (5) and extends above the guide tube (11) for transmitting axial oscillation to the oscillation damper (6, 6').

4. A hand-held power tool according to claim 1, wherein the excitation member (9) is formed as a ring-shaped member.

5. A hand-held power tool according to claim 1, wherein the oscillation damper (6') is formed as a hollow cylindrical element.

* * * * *